US006789366B1

(12) United States Patent
Febra

(10) Patent No.: US 6,789,366 B1
(45) Date of Patent: Sep. 14, 2004

(54) LOST MOULD ELEMENT FOR MANUFACTURING REINFORCED CONCRETE FLAT SLABS

(76) Inventor: António Francico Febra, Urbanizacao dos Camarinhos, N 33, Parceiros, Leiria (PT), P-2400

( * ) Notice: Subject to any disclaimer, the term of this patent is extended or adjusted under 35 U.S.C. 154(b) by 259 days.

(21) Appl. No.: 10/030,081

(22) PCT Filed: Jun. 29, 2000

(86) PCT No.: PCT/PT00/00008

§ 371 (c)(1),
(2), (4) Date: Jan. 11, 2002

(87) PCT Pub. No.: WO01/03898

PCT Pub. Date: Jan. 18, 2001

(30) Foreign Application Priority Data

Jul. 12, 1999 (PT) ..... 102332

(51) Int. Cl.[7] ..... E04C 3/30

(52) U.S. Cl. ..... 52/576; 52/577; 249/184; 249/186; 249/83

(58) Field of Search ..... 52/576, 577; 249/184, 249/186, 83, 60; 425/110

(56) References Cited

U.S. PATENT DOCUMENTS 1,031,334 A * 4/1912 Feldkamp ..... 249/186
1,329,978 A 2/1920 Kuhne
1,729,612 A 10/1929 Goldsmith
2,792,164 A * 5/1957 Cauffiel ..... 52/576
3,640,040 A * 2/1972 MacLean, III et al. ..... 52/576
4,979,720 A * 12/1990 Robinson ..... 249/184

FOREIGN PATENT DOCUMENTS

| | | |
|---|---|---|
| DE | 646 941 | 6/1937 |
| DE | 30 06 672 | 9/1981 |
| EP | 0 057 943 | 8/1982 |
| EP | 0 884 247 | 12/1998 |
| GB | 1 141 691 | 1/1969 |

* cited by examiner

*Primary Examiner*—Carl D. Friedman
*Assistant Examiner*—Nahid Amiri
(74) *Attorney, Agent, or Firm*—Oblon, Spivak, McClelland, Maier & Neustadt, P.C.

(57) ABSTRACT

A lost mold element for manufacturing reinforced concrete flat slabs, which is intended, when used together with other mold elements, for creating voids and for allowing the molding of beams. The mold element is made of a recycled plastic material, having a shape of a hollow box, substantially of a flat prismatic shape, and preferably rectangular or square, which is formed from two half boxes including an upper half box and a lower half box joined together removably. Each mold element has side or lateral walls with profiles that define together with other side or lateral walls of other mold elements an I-profiled channel or I-degenerated profiled channel for molding beams. Further, between the side or lateral walls are arranged steel rod attachments and distribution supports for securing the steel rods, and for reinforcement of the I-profiled or I-degenerated profiled beams. Such a mold element can be used in the building industry.

6 Claims, 17 Drawing Sheets

LOST MOULD ELEMENT FOR MANUFACTURING REINFORCED CONCRETE FLAT SLABS

TECHNICAL FIELD

The present invention concerns a reinforced concrete flat slab and the lost mold elements used in its manufacture. The reinforced concrete flat slab is a flat plate designed to span in two directions.

The present invention is directed to provide lost mold elements, preferably, of recycled plastic material, for manufacturing reinforced concrete flat slabs. They are intended for incorporation into the flat slabs and, thereby they also solve the environmental problem of the disposal of plastic material waste.

BACKGROUND ART

The prior art is described in EP 0 884 427, DE 30 06 672, GB 1 141 691, EP 0 057 943, U.S. Pat. No. 1,329,978, U.S. Pat. No. 1,729,612, and DE 646 941. The most relevant prior art document is document EP 0 884 427, in which is claimed a mold having a box shape, which is made of recycled plastic material. In fact all these references are quite different from solution presented by the present invention as set forth in the following discussion.

DISCLOSURE OF THE INVENTION

The mold elements according to the present invention are intended to create voids inside of the reinforced concrete flat slabs and, hence to lighten the flat slab, as well as to allow the molding of beams reinforced with steel rods, which are defined by the sides or lateral wall of the mold elements and which include reinforcing steel rods in their interior. The inclusion reinforcing steel rods is possible thanks to the supporting parts for the steel rods, which are connected to mold elements.

The use of voids and beams in the manufacturing of conventional reinforced concrete flat slabs has as its object providing stronger and lighter reinforced concrete flat slabs.

The casting of the reinforced concrete flat slabs, with this type of mold rises to types of problems. The first is that mold elements are prone to float in the fresh concrete, because the mold elements are hollow and the difference density between the mold elements and the fresh concrete and additionally to the bonding of the fresh concrete to the mold. The second problem is the evacuation of the air during the casting, as sometimes are created air chambers near the bottom of the mold elements, when during the casting of the flat slab vibration is applied to the concrete mass.

For solving the first problem, the mold element according to the invention has attachment means for securing the mold element, which do not allow its floatation, and grooves and substantially cylindrical hollow parts, which allows the concrete to run all around the surface involving the mold element and be better bonded to it.

For solving the second type of problem, according to the invention openings and gaps are arranged for air evacuation, which allow the air circulation through the mold element and hence its easier evacuation.

Accordingly, the present invention provides a reinforced concrete flat slab comprising lost mold elements, which are intended, when used together with other mold elements, for creating voids and allowing the casting of reinforced beams, the mold element being made of recycled plastic material and having the shape of a hollow box, substantially of a flat prismatic shape, characterized in that the lost mold element is formed from two half boxes, an upper one and a lower one, removably joined together, each mold element having sides or lateral walls, with profiles, which define together with other sides or lateral walls of other mold elements, "I" shaped profiled channels for casting beams, whereby between the sides or lateral walls are arranged steel rod attachments and distribution supports for securing the steel rods, for reinforcement of said "I" shaped beams.

According to a first variant of the present invention the said lost mold element has a base arrangement, the lower main face being in the bottom of the said lower half box, spaced apart of said base arrangement, at least said lower main face of said lower half box having grooves, the lateral walls and said base arrangement of said mold element having skew notches, for the different steel rod attachment and distribution supports, for securing the steel rods, the protuberances or nails being secured in said lower face of said lower half box, there being substantially cylindrical hollow connecting parts in the internal faces of said half boxes, which provide to the mold element with a good compression and deformation resistance, said base arrangement being secured to the lower half box by means of skew notches, which allow the existence of a pre-set gap for the air circulation, there being also small openings in said upper half box, covered with a very thin plastic film, which allow, whenever such is necessary, air circulation.

Each mold element has sides or lateral walls with the profiles, which define together with others sides or lateral walls of the others mold elements, "I" shaped profiled channels for casting means.

The mold element for beams according with the present invention presents spacer feet in the lower face of lower half box.

The junction between the two half boxes of the mold element is removable and includes skew notches.

According to the present invention the mold element has such dimensions and geometry to allow the easier control of all dimensions requested by the flat slabs in which they are going to be included.

The mold element has grooves, which allow for better flowing and bonding of the fresh concrete in the areas more strangled, this is, the lower portion of the mold element.

According to a second variant of the present invention, the sides or lateral walls of the said mold element have a corrugated configuration, for providing a greater resistance to them, and the main upper and lower faces presenting skew notches and the lateral walls of said mold element presenting holes for nesting the steel rod attachment and distribution supports. The corrugated configuration consists of ridges, said ridges being triangular shaped, and arranged in such a way that the bases of the triangles are disposed close to the separation plan of said two half boxes. The main faces have at least two grooves parallel one another and parallel to an edge of the main face of the mold element and several spacer feet, perpendicular to said faces, arranged evenly upon the its surface, each one having at least one flange with a recess for receiving a steel rod. The internal faces of said half boxes have substantially cylindrical connection hollow parts, which provide to the mold element a good compression and deformation strength, there being further small openings in said mold element, which allow, whenever such is necessary, air circulation.

Each mold element has sides or lateral walls with profiles, which define together with others sides or lateral walls of the others mold elements, "I" shaped profiled channels for casing beams, the spacing between each one of said mold elements being determined by the steel rod attachment and distribution supports.

The junction between the two half boxes of the mold element is removable.

According to the present invention thr mould element has such dimensions and geometry to allow the easier control of all dimensions requested by the flat slabs in which they are going to be included.

The mold element has grooves, which allow for better flowing and bonding of the concrete in the areas more strangled, this is, the lower portion of the mold element.

BRIEF DESCRIPTION OF THE DRAWINGS

The invention will be now explained in greater detail by mean of examples with the help of the appended drawings, in which.

BEST MODES FOR CARRYING OUT THE INVENTION

Figure 1:
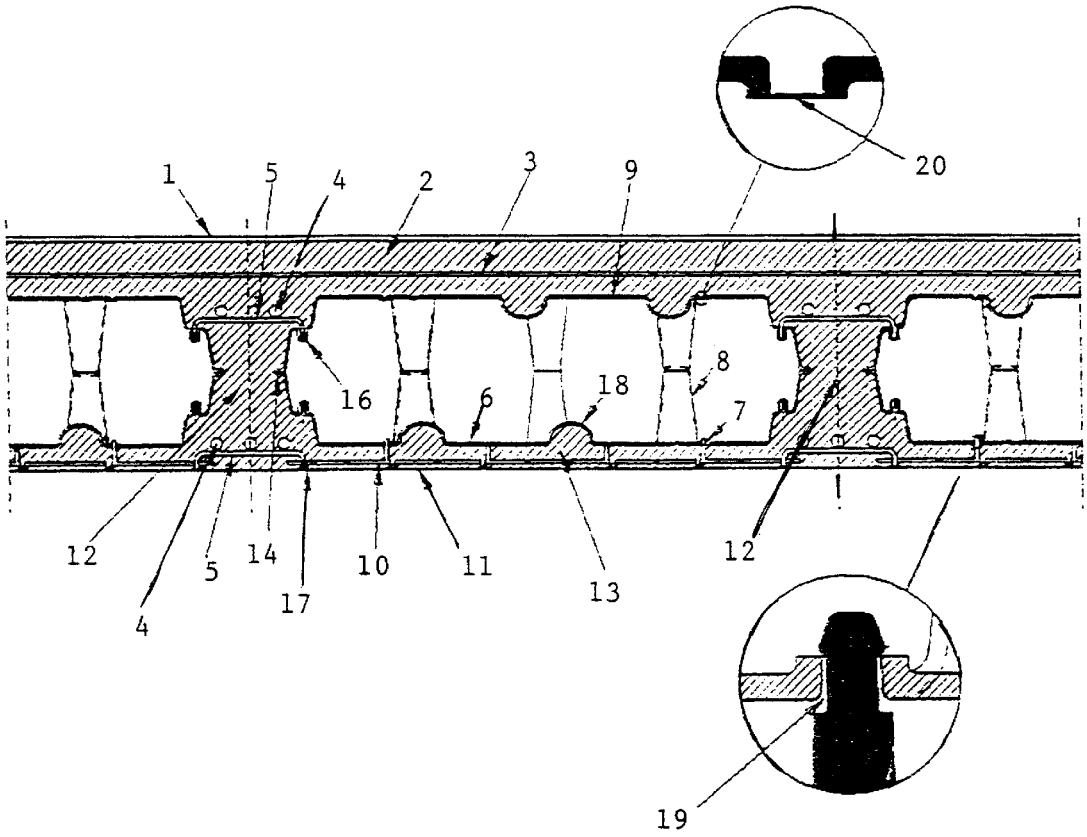
FIG. 1 is a sectional view of reinforced concrete flat slabs, in which are incorporated the mold elements of a first embodiment of the first variant of present invention, as well as two enlarged sectional details of said mold elements.

As shown in the FIG. 1, the reinforced concrete flat slab manufactured with the mold elements according with the first variant of present invention, is composed of a first layer of concrete, arranged between a floor layer 1 and sheathing 11, within of the concrete layer being arranged a set of mold elements 6, 9, spaced from said sheathing 11, a metallic screen 3 preferably electric welded netting type, between the upper faces of said mold elements 6, 9 and spaced apart from both said faces and said floor layer 1. The set of mold elements 6, 9 form together laterally channels for casting the beams which channels preferably define beams 12 with "I" shaped profiles, before the casting of fresh concrete being mounted in said channels for casting the beams 12, by engagement in lateral edges of the mold elements and in the base arrangement 10, steel rod attachment and distribution supports 5, for securing the reinforcing steel rods 4 at least in two areas of said channels for casting the beams 12.

Figure 4:
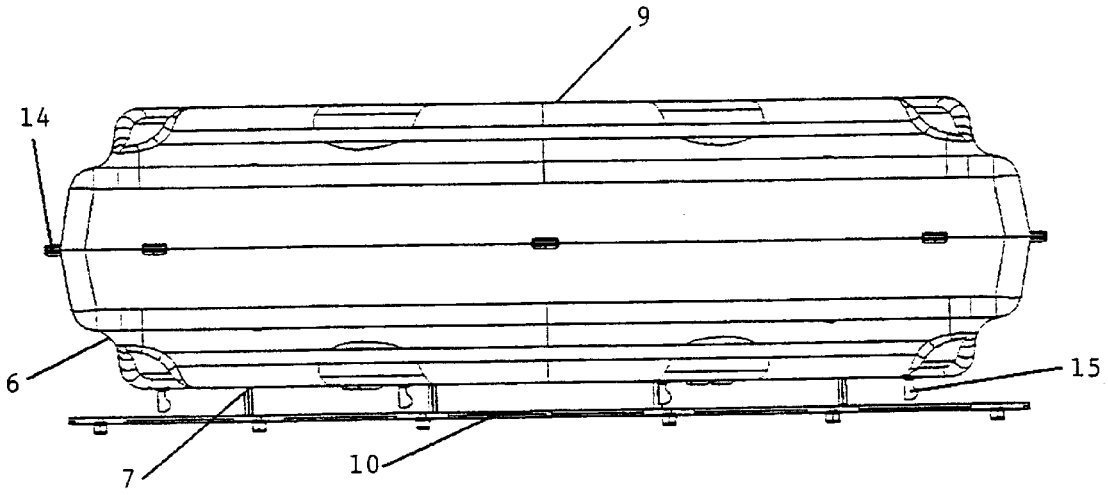
FIG. 4 is a side view of the mold element of FIG, 2.

In FIG. 1 can also be seen in detail the configuration of the engagement between the holes of the main face of the lower half box 6 and the vertical engagement spacers 7 (FIG. 4) and the gap 19, existent between them, as well as the holes for air evacuation 20 in the main face of said upper half box 9.

Figure 2:
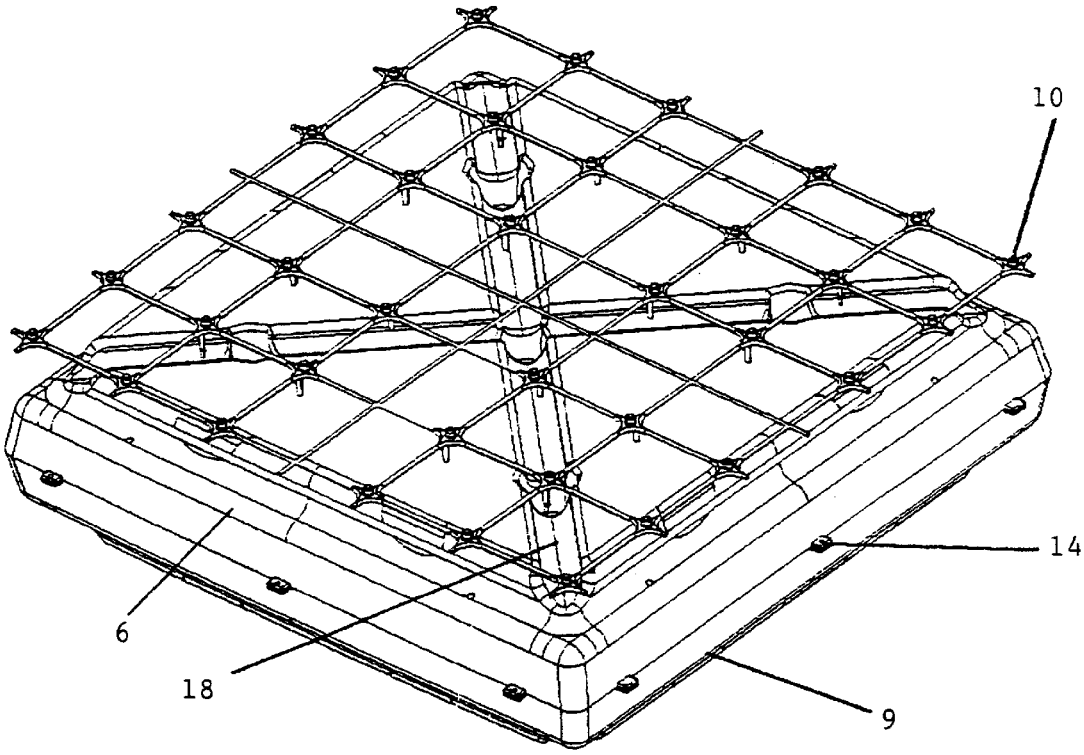
FIG. 2 is a bottom perspective view of the mold element according the first embodiment of the first variant of present invention.

According to FIG. 2 the mold element 6, 9, manufactured of recycled plastic material having the shape of a hollow box, substantially of flat prismatic shape, preferably, rectangular or square, which is formed from two half boxes, a upper one 9 and a lower one 6, joined together removably, for example, by way of several peripheral skew notches 14, the main face of the lower half box 6 having connected a base arrangement 10, comprised of a screen and a plurality of nesting vertical spacers 7 (FIG. 4), which engage in holes existent in said main face of said lower half mold box 6.

Figure 3:
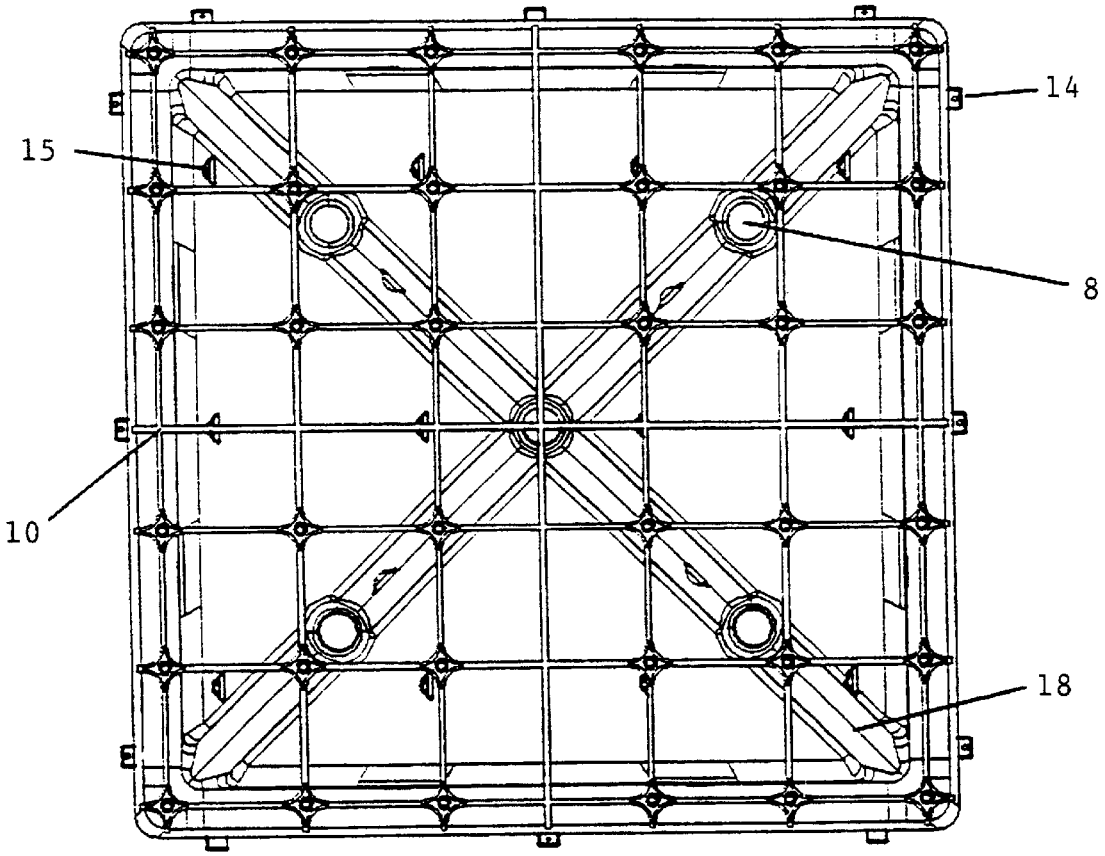
FIG. 3 is a bottom plan view of the half box of the mold element of FIG. 2.

As shown in FIG. 3 the main face of said lower half box 6 presents four holes for inlet in the substantially cylindrical hollow parts 8, a plurality of protuberances or nails 15 evenly arranged which cause a better bonding of the concrete in the mold element.

Figure 5:
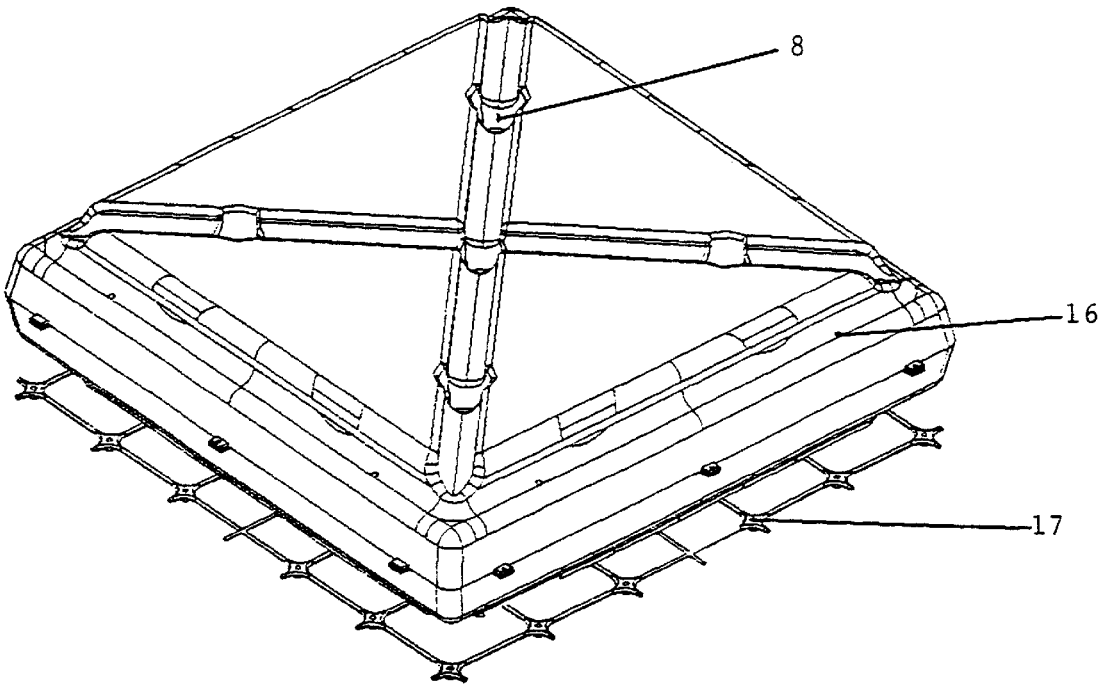
FIG. 5 is a top perspective view of the mold element of FIG. 2.

As can be seen in FIG. 5 the main face of said upper half box 9 has grooves similar to the grooves 18 existent in main face of said lower half box 6 and four holes in correspondence to the said substantially cylindrical hollow parts 8. Several skew notches 16 are also provided for the steel rod attachment and distribution supports 5.

Figure 6:
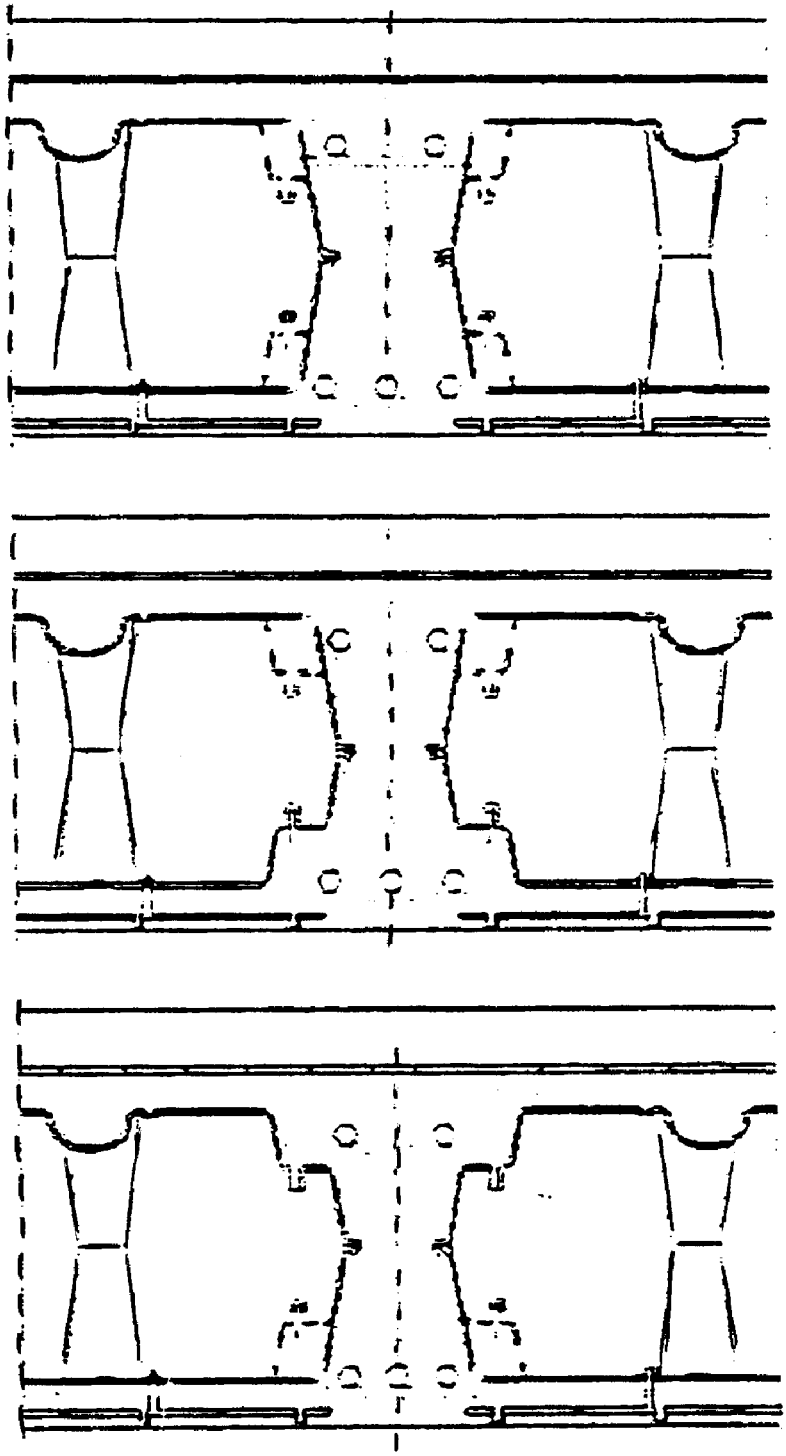
FIG. 6 shows three partial sectional views of reinforced concrete flat slabs, which use the mold elements of FIG. 2.

In the three views of FIG. 6 is shown the formation of the "I" shaped profiles.

Figure 7:
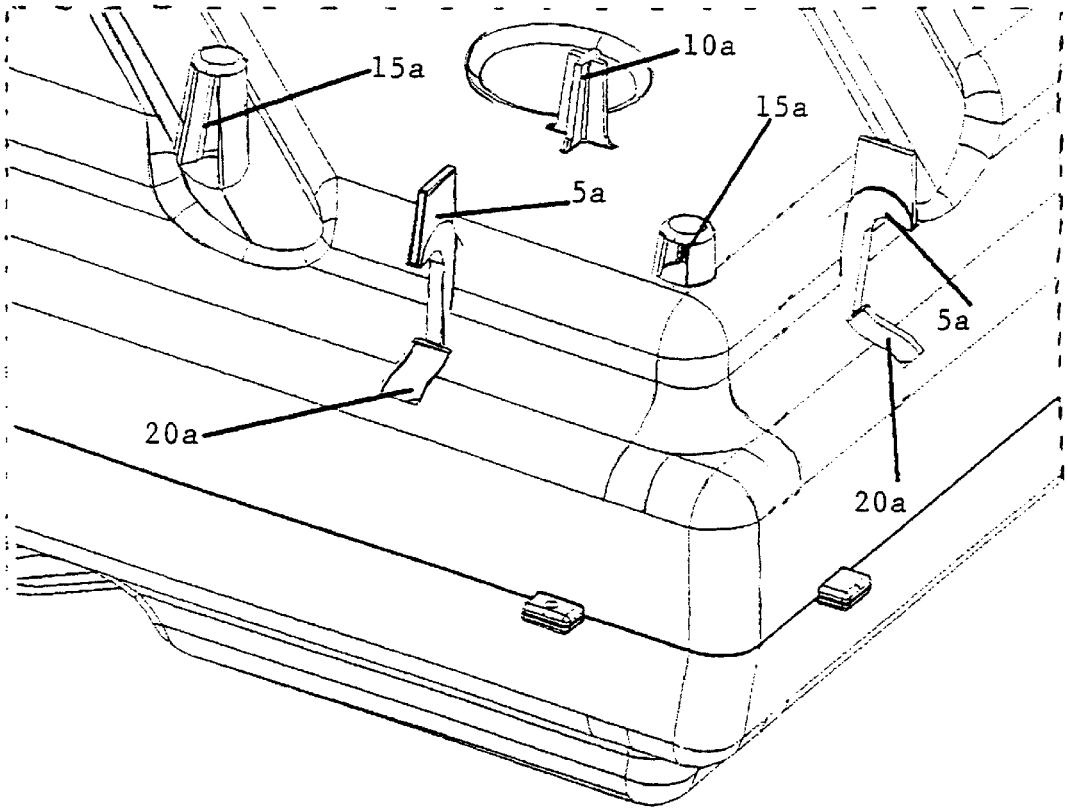
FIG. 7 shows an enlarged detail corresponding to FIG. 8.
Figure 8:
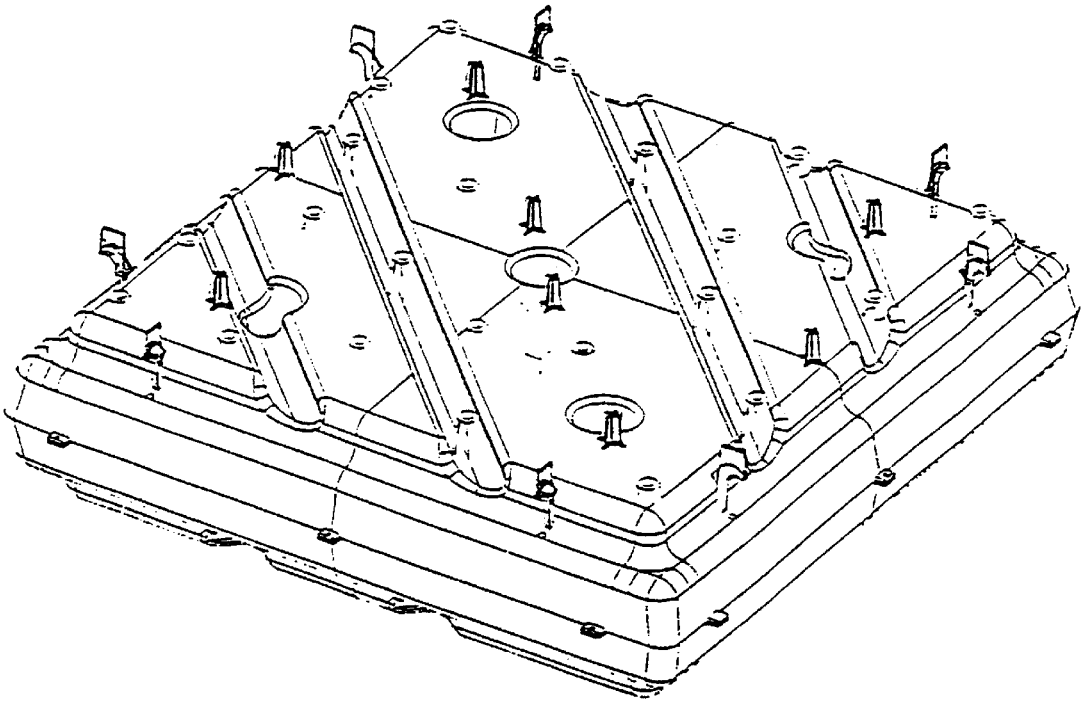

FIGS. 7 and 8 show an alternative embodiment of the first variant of the mold element of the present invention. As can be seen the arrangement of the grooves 18*a* is different, as well as the number of inlet holes for the substantially cylindrical hollow parts 8*a*, and furthermore the base arrangement 10*a*, does not include a web but only three spacer feet 10*a*. In this case a screen is not used in the embodiment anterior, and the steel rod attachment and distribution supports 5 are fitted in the skew notches 16*a*.

Figure 9:
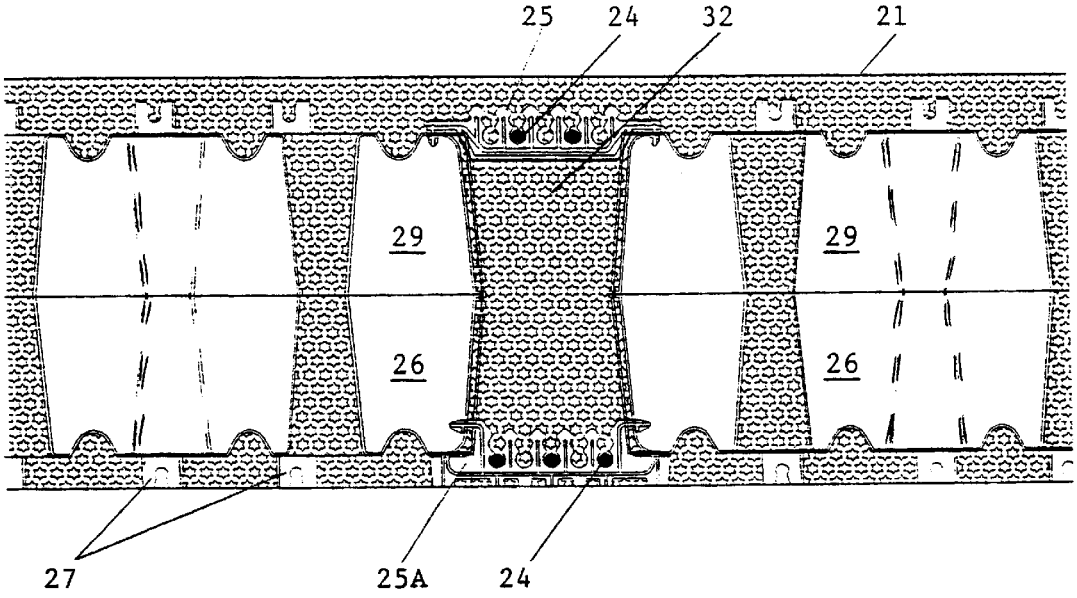
FIG. 9 is a sectional view of a reinforced concrete flat slab, in which are incorporated the mold elements of an embodiment of the second variant of present invention.
Figure 10:
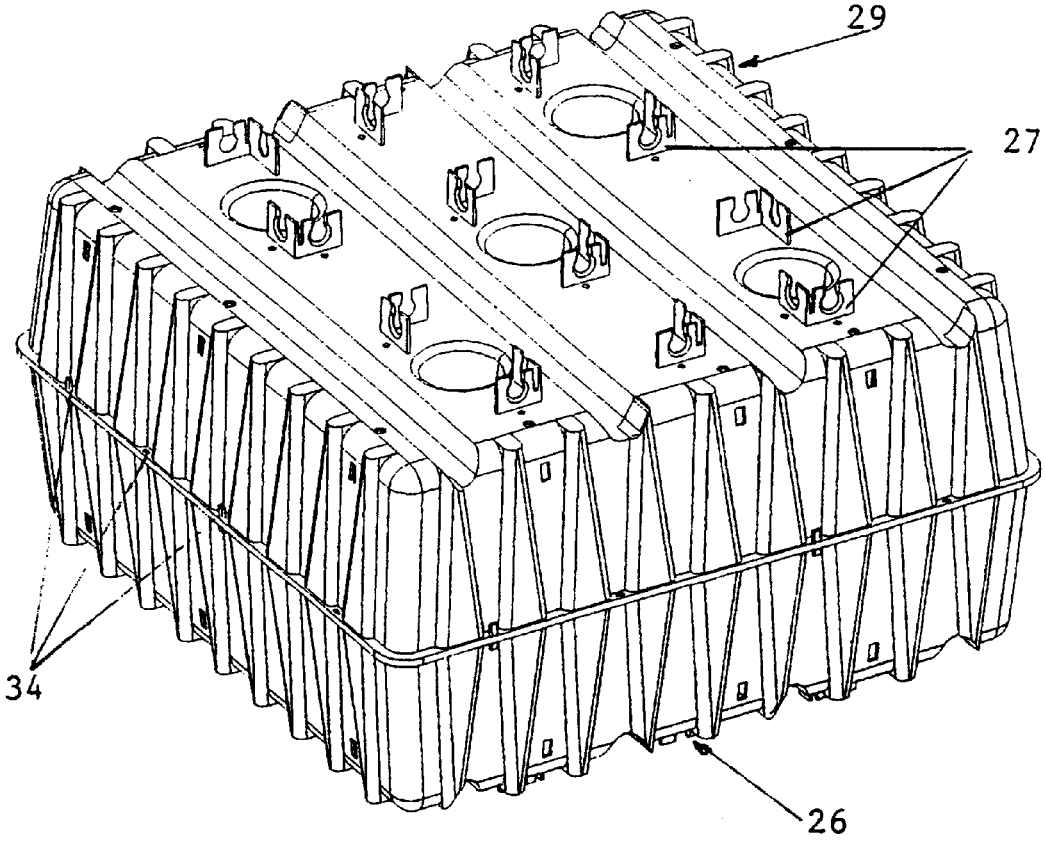
FIG. 10 is a perspective view of a mold element of an embodiment of the second variant of present invention.

As shown in FIG. 9 the reinforced concrete flat slab manufactured with the mold elements according to an embodiment of the second variant of the present invention, is composed by a first layer of concrete, arranged between a floor layer 21 and a sheathing (not shown), inside of concrete layer being arranged a set of mold elements 26, 29, spaced from said sheathing by lower feet 27 and the base of the steel rod attachment and distribution supports 25A. The set of mold elements 26, 29 forms together laterally channels 32 for molding beams, which channels define preferably beams 32 with "I" shaped profiles, before the casting of fresh concrete being mounted in said channels for molding the beams 32, by engagement in the sides and in the main faces of the mold elements, steel rod attachment and distribution supports 25, 25A for securing the steel rods 24 at least in two areas of the casting beam channels 32. Of course, the mold elements 26, 29 can be used instead of the said mold elements 6, 9 in the embodiment of FIG. 1.

Figure 11:
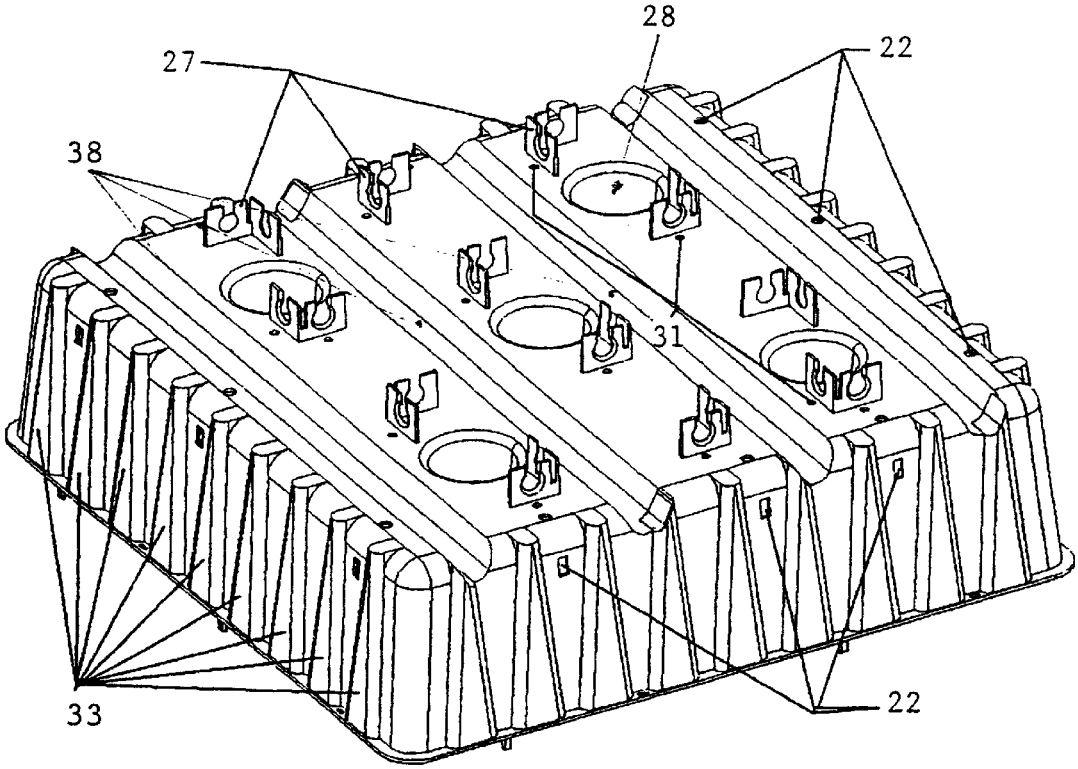
FIG. 11 is perspective view of the outside of the half box of the mold element of FIG. 10.
Figure 12:
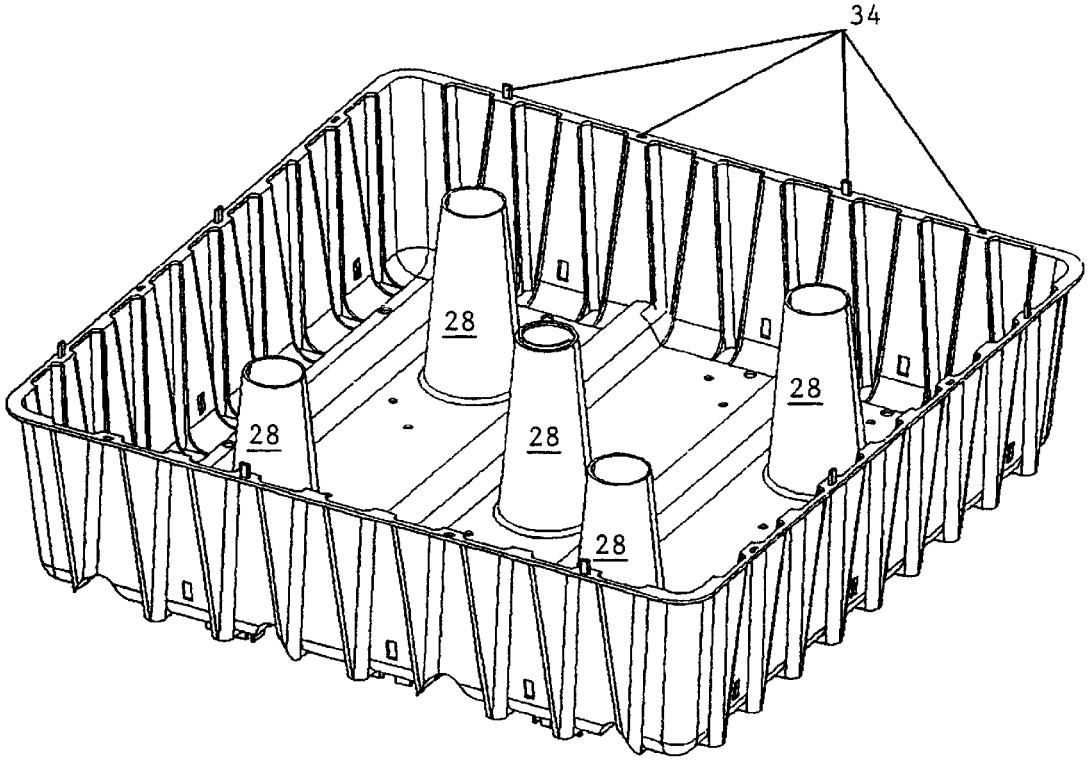
FIG. 12 is a perspective view of the inside of the half box of the mold element of FIG. 10.
Figure 13:
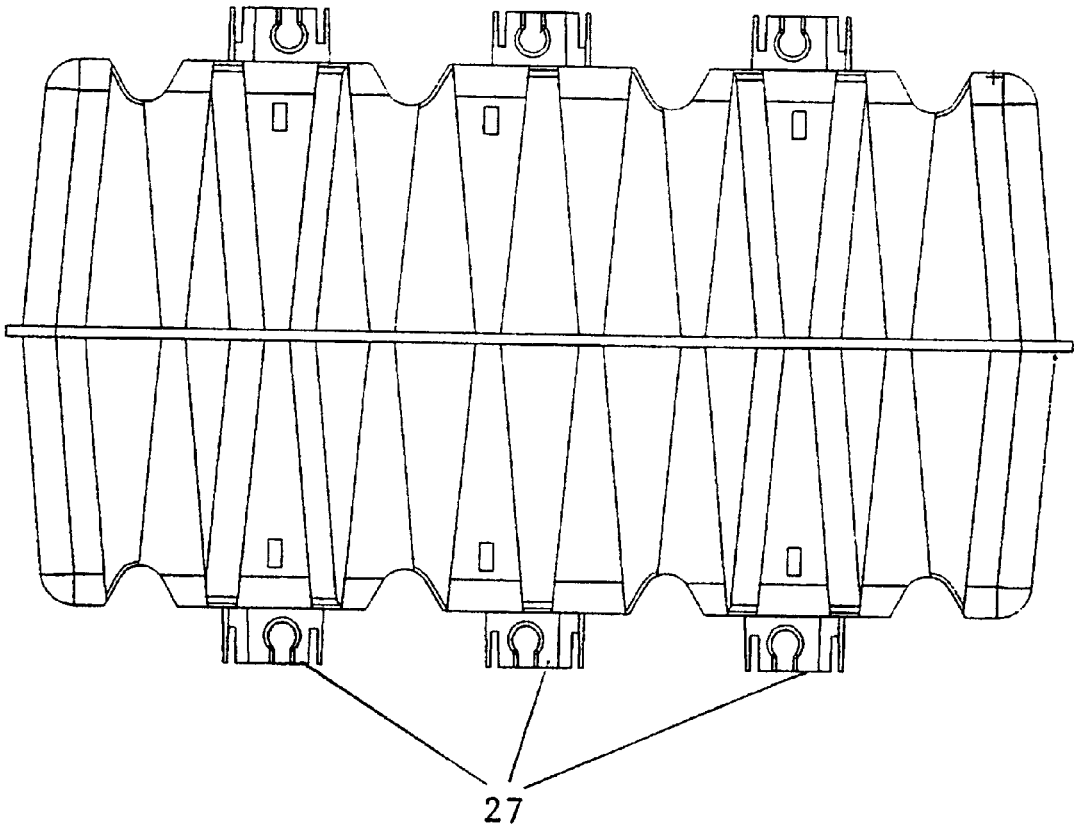
FIG. 13 is a side elevation view of the mold element of FIG. 10.

As shown in FIGS. 10, 11, 12, and 13 the mold element 26, 29, which is made of recycled plastic material, having the shape of a hollow box substantially of a flat prismatic shape, preferably, rectangular or square, which is formed from to identical half boxes, a upper one 29 and a lower one 26, removably joined together, for example, by way of several peripheral skew notches 34, and a plurality of feet 27, disposed perpendicularly and evenly in upper and lower faces of said mold element 26, 29, each of them having two perpendicular flat flanges which has each a recess with a keyhole shape for receiving an steel rod or facilities. As shown in these figures the main faces of the mold element 26, 29 present five inlet holes for the substantially cylindrical hollow parts 28 there being further small openings 31 in said mold element, which allow, whenever such is necessary, air circulation. The main faces of the mold element 26, 29 present further grooves 38 and three pairs of holes 22 in correspondence with each edge of the main upper and lower faces of said mold element for engagement of the upper steel rod attachment and distribution supports 25 (holes 22 in the main face) and lower steel rod attachment and distribution supports 25A (holes 22 in the lateral wall). In FIGS. 11 and 12 can be seen the substantially cylindrical hollow parts 28.

Figure 14:
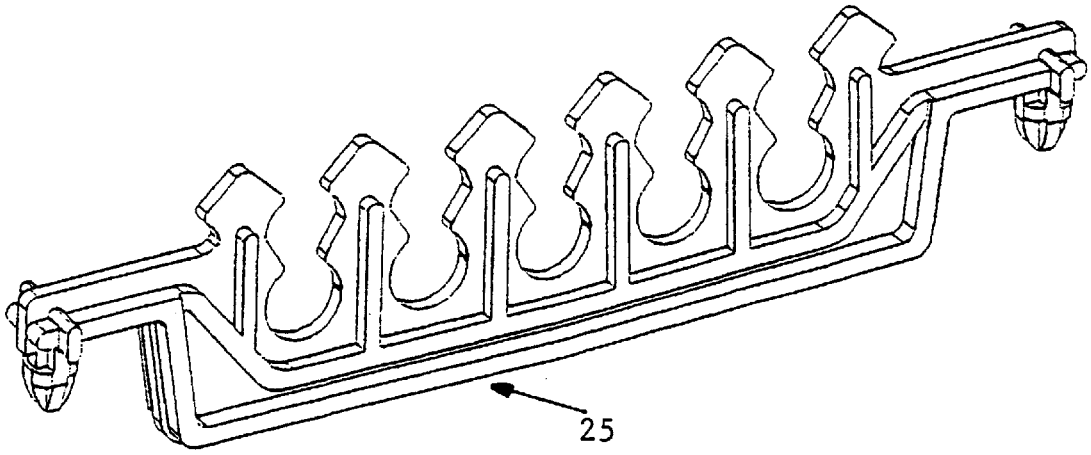
FIG. 14 is a perspective view of the upper steel rod attachment and distribution support, used by the mold element of FIG. 10.
Figure 15:
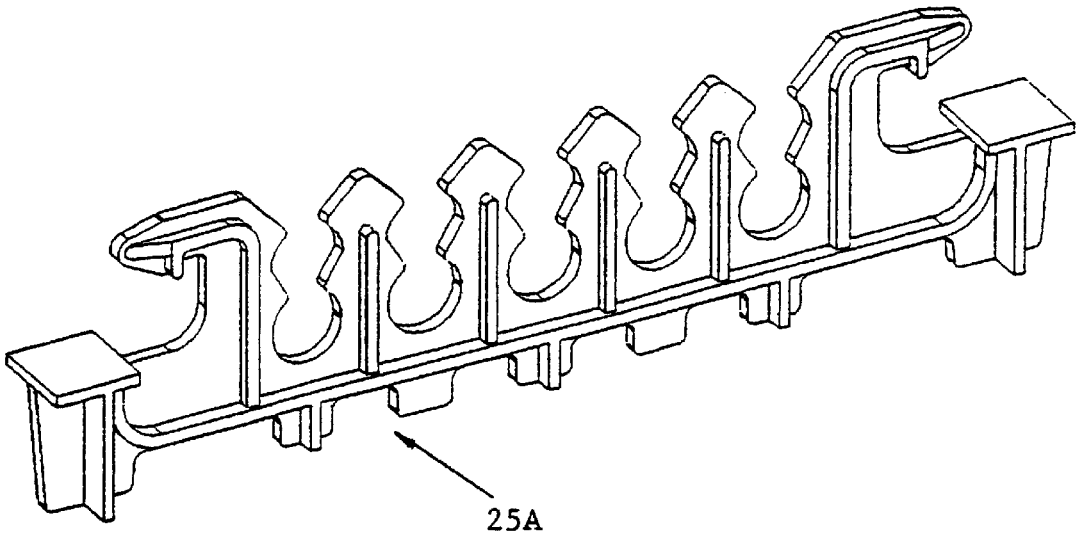
FIG. 15 is a perspective view of the lower steel rod attachment and distribution support, used by the mold elements of FIG. 10.

In FIGS. 14 and 15 are shown respectively the upper and lower steel rod attachment and distribution supports 25, 25A, the upper support 25 being comprised by a plastic molded profile, with its ends configured to engage in holes in the upper main face of said mold element as seen in FIG. 9, and the lower support being comprised by a plastic molded profile with its ends configured to engage in holes in the lateral walls of the mold element, as seen in FIG. 9. The upper support in the configuration shown in FIG. 14 has recesses for receiving the steel rods 24 and the configuration shown in FIG. 15 has also recesses for receiving the steel rods 24.

Figure 16:
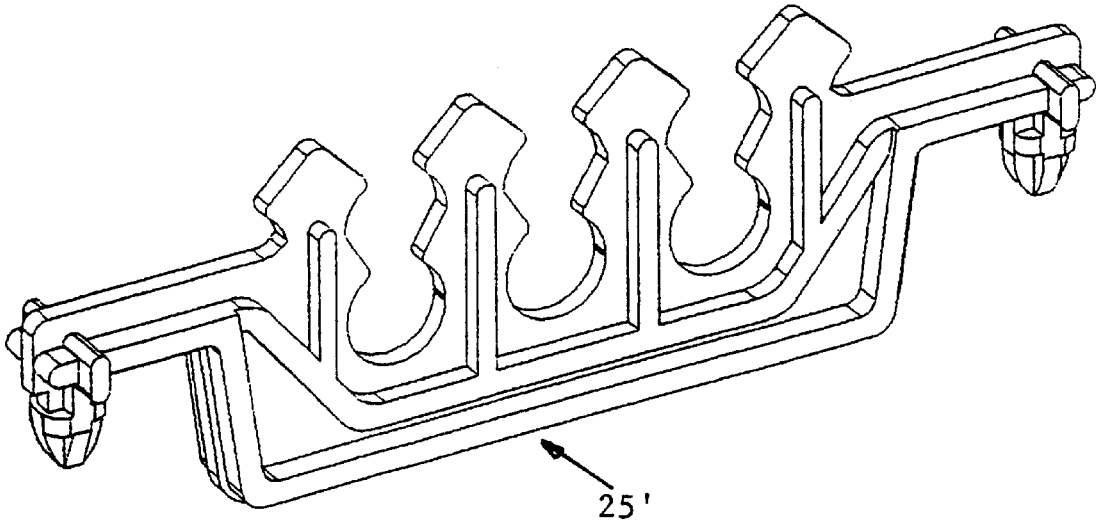
FIG. 16 is a perspective view of the another embodiment of the upper steel rod attachment and distribution support, used by half boxes of the mold element of FIG. 10.
Figure 17:
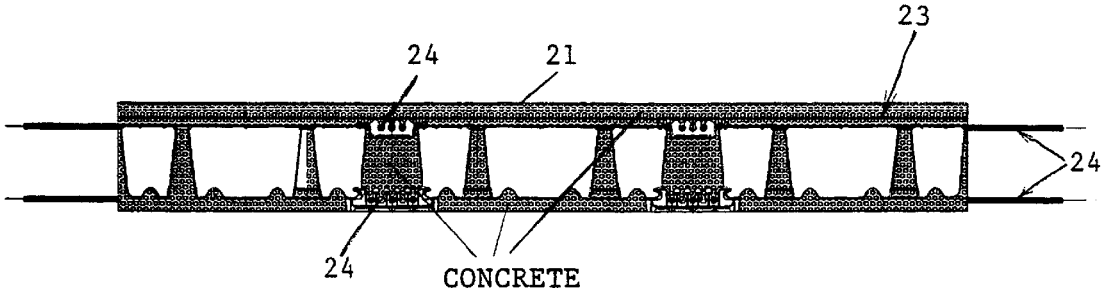
FIG. 17 is another sectional view of another reinforced concrete flab slab, wherein are incorporated half boxes of the mold elements of the embodiment of the second variant of the present invention.

In another embodiment shown in FIG. 16, the upper support 25' has three recesses and is used with the half boxes 26 in the embodiment shown in FIG. 17.

Although the present invention has been shown and described with reference to the preferred embodiments, it must be immediately understood that modifications can be done within the scope of the appended claims and what is obvious to those skilled in the art, when such are taken into consideration with respect to the teachings provided by the present specification.

What is claimed is:

1. A lost mold element, configured, when used together with other lost mold elements, to create voids and to allow casting of beams, wherein:

the lost mold element is made of recycled plastic material, has a main face, and has a shape of a hollow box substantially of flat prismatic shape, the lost mold element is formed from two half boxes, having main faces, an upper half box and a lower half box, removably joined together, the lost mold element having sides or lateral walls with profiles that define, together with other sides or lateral walls of the other lost mold elements, I-profiled channels for casing beams, and between the sides or lateral walls are positioned steel rod attachment and distribution supports for securing steel rods thereto for reinforcement of the I-profiled beams wherein the main faces have at least two grooves parallel to one another and parallel to an edge of the main face of the mold element, and a plurality of spacer feet, perpendicular to the main faces, arranged evenly on the surface of the main face of the mold element, each of said spacer feet having at least one flange with a recess for receiving one of the steel rods.

2. Lost mold element according to claim 1 wherein the side or lateral walls have a corrugated configuration, for providing a resistance to them, and the main upper and lower faces and the lateral walls of the mold element have holes, for the steel rod attachment and distribution connection supports.

3. Lost mold element according to claim 2, wherein the corrugated configuration includes ridges, the ridges being triangular, and arranged in such a way that bases of the triangles are disposed close of a separation plan of the two half boxes.

4. Lost mold element according to claim 2, wherein in the internal faces of the half boxes are disposed substantially cylindrical hollow connecting parts, which provide the mold element with compression and deformation resistance, and small openings in the half boxes to allow air circulation.

5. A lost mold element, configured, when used together with other lost mold elements, to create voids and to allow casting of beams, wherein:

the lost mold element is made of recycled plastic material and has a shape of a hollow box substantially of flat prismatic shape, the lost mold element is formed from two half boxes, an upper half box and a lower half box, joined together removably, the lost mold element having sides or lateral walls with profiles that define, together with other sides or lateral walls of the other lost mold elements, I-profiled channels for casing beams, and between the sides or lateral walls are arranged steel rod attachment and distribution supports for securing the steel rods, for reinforcement of the I-profiled beams, wherein the steel rod attachment and distribution supports are provided with recesses for receiving the steel rods.

6. A lost mold element according to claim 5, wherein at least one of the half boxes has a main face having at least two grooves parallel to one another and parallel to an edge of the main face and which comprises a plurality of spacer feet, positioned perpendicular to the main face, arranged evenly on the surface of the main face, each of said spacer feet having at least one flange with a recess for receiving the steel rods.

* * * * *

UNITED STATES PATENT AND TRADEMARK OFFICE

CERTIFICATE OF CORRECTION

PATENT NO. : 6,789,366 B1
DATED : September 14, 2004
INVENTOR(S) : Febra

It is certified that error appears in the above-identified patent and that said Letters Patent is hereby corrected as shown below:

Title page,
Item [76], Inventor, should read:
-- [76] Inventor: Antonio Francisco Febra, Urbanizacao dos Camarinhos, N 33, Parceiros, Leiria (PT), P-2400 --

Signed and Sealed this

Sixteenth Day of November, 2004

JON W. DUDAS
*Director of the United States Patent and Trademark Office*